US006189220B1

(12) United States Patent
Chen

(10) Patent No.: US 6,189,220 B1
(45) Date of Patent: Feb. 20, 2001

(54) PUNCH HAVING CHANGEABLE PUNCHING MEMBER

(75) Inventor: Cheng Nan Chen, Chong Ho (TW)

(73) Assignee: Yu Hsun Hsuan, Taipei Hsien (TW)

( * ) Notice: Under 35 U.S.C. 154(b), the term of this patent shall be extended for 0 days.

(21) Appl. No.: 09/425,558

(22) Filed: Oct. 22, 1999

(51) Int. Cl.[7] ..... B26F 1/02
(52) U.S. Cl. ..... 30/358; 30/363
(58) Field of Search ..... 30/358, 363

(56) References Cited

U.S. PATENT DOCUMENTS 2,359,699 * 10/1944 Valentine ..... 30/363
3,108,558 * 10/1963 Galvin ..... 30/363
3,748,940 * 7/1973 Muri ..... 83/414
4,281,459 * 8/1981 Krieg ..... 30/228
4,487,566 * 12/1984 Barna ..... 30/367
5,303,625 * 4/1994 Hai-Shen ..... 83/447
5,560,110 * 10/1996 Haines ..... 30/363
5,647,278 * 7/1997 Wu ..... 30/358
6,076,447 * 6/2000 Damask ..... 83/618
6,089,137 * 7/2000 Lee ..... 30/358

* cited by examiner

*Primary Examiner*—M. Rachuba
*Assistant Examiner*—Sean Pryor

(57) ABSTRACT

A punch includes a socket disposed on a plate, a barrel supported above the plate, a shaft slidably received in the barrel and a mold piece detachably secured to the shaft. One or more levers have one end pivotally secured to the barrel and have a middle portion coupled to the shaft for moving the shaft and the mold piece downward to actuate on the socket. The mold piece is detachably secured to the shaft with a threaded ferrule. The punch includes one or more mold pieces and sockets of various shapes which may be replaced with each other.

12 Claims, 5 Drawing Sheets

PUNCH HAVING CHANGEABLE PUNCHING MEMBER

BACKGROUND OF THE INVENTION

1. Field of the Invention

The present invention relates to a punch, and more particularly to a punch having one or more punching members that may be replaced with each other.

2. Description of the Prior Art

Typical punches comprise a punch rod slidably received in a housing, a knob secured on top of the punch rod for forcing the punch rod downward to cut or to punch the sheet members. A spring is engaged with the punch rod for biasing the punch rod away from the sheet members before the punch rod is depressed against the sheet members. The punch rod has a predetermined shape which may be used to punch or to form a predetermine-shaped pattern on the sheet members. The patterns may not be changed.

The present invention has arisen to mitigate and/or obviate the afore-described disadvantages of the conventional punches.

SUMMARY OF THE INVENTION

The primary objective of the present invention is to provide a punch including one or more punching members that may be replaced and changed with each other according to the user's need.

In accordance with one aspect of the invention, there is provided a punch comprising a plate, a socket supported on the plate and including a recess formed therein, a barrel supported above the plate, a shaft slidably received in the barrel and including a bottom end extended downward and outward of the barrel, a mold piece, means for detachably securing the mold piece to the bottom end of the shaft, means for moving the shaft and the mold piece downward to actuate on the socket.

The moving means includes at least one lever having a first end pivotally secured to the barrel at a pivot axle and having a middle portion, and a pin engaged through the middle portions of the lever and engaged through the shaft for coupling the lever to the shaft. The barrel includes at least one oblong hole formed therein for slidably receiving the pin and for guiding the pin to be moved up and down relative to the barrel. The shaft includes at least two holes formed therein for selectively receiving the pin. A spring means is further provided for biasing the shaft and the mold piece away from the socket.

The detachably securing means includes a ferrule rotatably secured to the shaft, and means for attaching the mold piece to the ferrule. The attaching means includes an inner thread formed in the ferrule, and an outer thread formed on the mold piece and threaded with the inner thread of the ferrule to secure the mold piece to the ferrule. A device is further provided for preventing the mold piece from rotating relative to the shaft and includes a stud extended from the shaft, and a cavity formed in the mold piece for receiving the stud of the shaft, the cavity of the mold piece and the stud of the shaft include a corresponding non-circular cross section for preventing the mold piece from rotating relative to the shaft.

A device is further provided for preventing the socket from rotating relative to the plate and includes one or more projections extended inward of an opening of the plate, and one or more notches formed in the socket for receiving the projections and for preventing the socket from rotating relative to the plate.

The socket includes a recess formed therein, the mold piece includes a mold element extended therefrom for engaging into the recess of the socket. A pad is further engaged into the recess of the socket.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
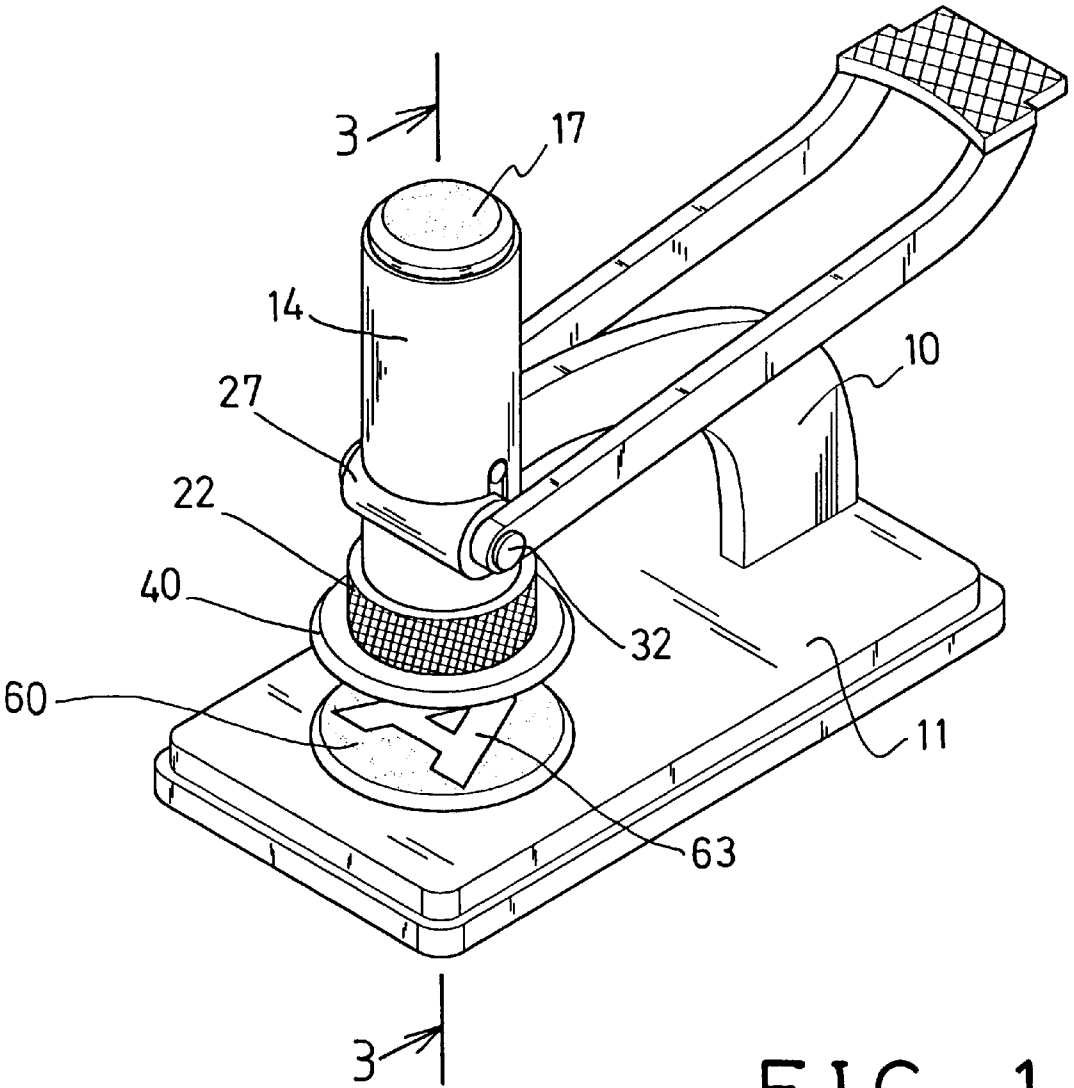
FIG. 1 is a perspective view of a punch in accordance with the present invention.
Figure 2:
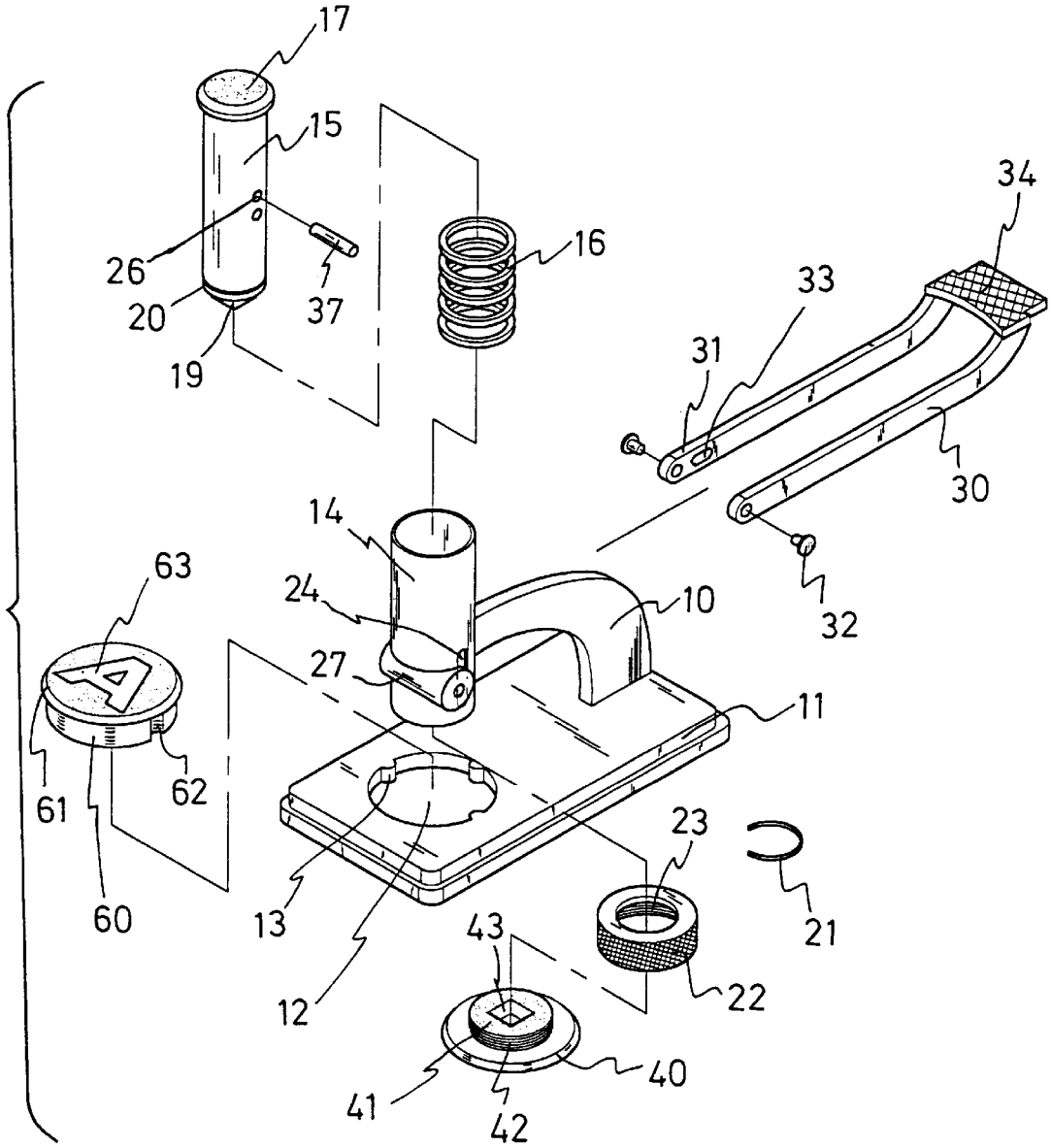
FIG. 2 is an exploded view of the punch.
Figure 3:
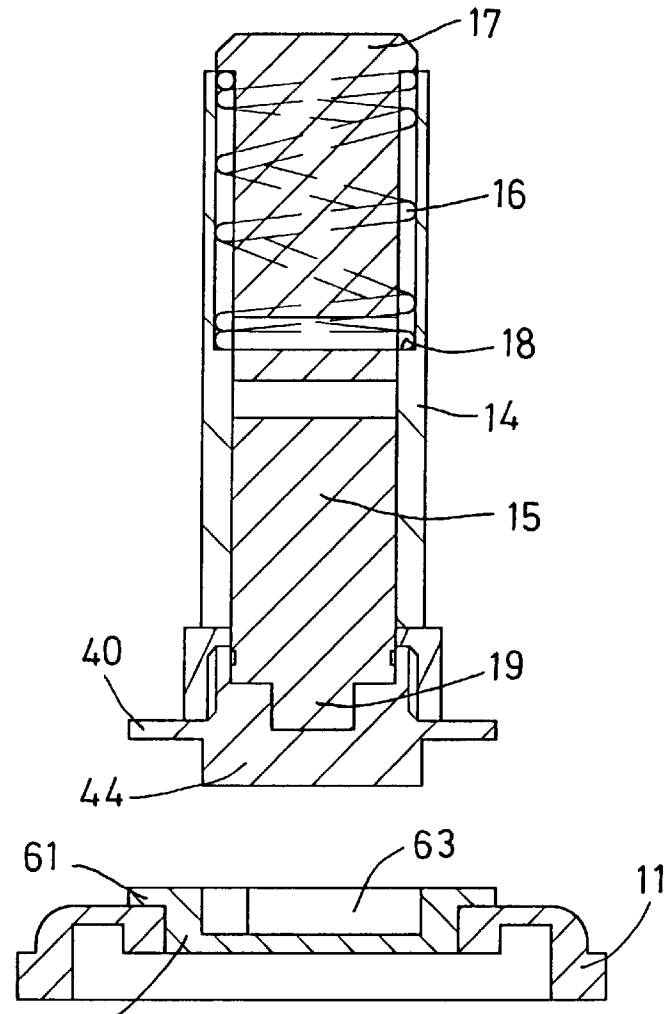
FIG. 3 is a cross sectional view of the punch, taken along lines 3—3 of FIG. 1.

Referring to the drawings, and initially to FIGS. 1–3, a punch in accordance with the present invention comprises an arm 10 secured on a plate 11 which includes an opening 12 formed therein and one or more projections 13 extended inward of the opening 12 of the plate 11. It is preferable that the arm 10 includes a bent portion formed in the middle portion thereof. A barrel 14 is secured to the upper end of the arm 10 for receiving a shaft 15 and a spring 16 therein and includes a peripheral shoulder 18 formed therein for engaging with the spring 16 and for retaining the spring 16 in the barrel 14. The shaft 15 includes a head 17 provided on top thereof and engaged with the spring 16 such that the spring 16 may bias the shaft 15 upward relative to the barrel 14 or may bias the shaft 15 upward away from the plate 11. The shaft 15 includes a stud 19 extended downward and outward of the barrel 14 and having a non-circular cross section, such as the square cross section or the like. The shaft 15 includes an annular groove 20 formed in the lower portion thereof for receiving a clamping ring 21 which may rotatably secure a ferrule 22 to the shaft 15. The ferrule 22 includes an inner thread 23 formed therein. The barrel 14 includes one or a pair of oblong holes 24 (FIG. 2) formed therein for slidably receiving a pin 37 which is engaged through either of the holes 26 of the shaft 15 (FIG. 5), such that the pin 37 moves up and down in concert with the shaft 15, and such that the sliding movement of the pin 37 is limited by the oblong holes 24 of the barrel 14.

A pair of levers 30 each includes one end 31 pivotally secured to a hub 27 of the barrel 14 at a pivot axle 32 that is formed by one or more fasteners 32. The levers 30 each includes one or more oblong holes 33 formed therein and located close to the one end 31 thereof for receiving the end portions of the pin 37 such that the lever 30 may move the shaft 15 downward against the spring 16 by rotating the lever 30 about the pivot axle 32. The lever 30 includes a handle 34 formed on the other end opposite to the pivot axle 32 such that the lever 30 may be rotated about the pivot axle 32 against the spring 16 by actuating the handle 34. The distance between the handle 34 and the pin 37 is preferably greater than the distance between the pin 37 and the pivot axle 32, such that the moving distance or the moving stroke of the pin 37 is limited, and such that the handle 34 may apply a great torque to the shaft 15 via the pin 37.

It is to be noted that the pin 37 may be engaged through either of the holes 26 of the shaft 15 (FIGS. 5, 6) such that the pin 37 may be adjusted up and down relative to the shaft 15 in order to adjust the moving stroke or the sliding movement of the shaft 15 relative to the barrel 14. Although one pair of the levers 30 are shown in the drawings, alternatively, the barrel 14 and the shaft 15 may each include an oblong hole formed therein and aligned with each other for receiving a single lever 30 which is good enough to move the shaft 15 up and down relative to the barrel 14.

A mold piece 40 includes a protrusion 41 extended upward therefrom and having an outer thread 42 formed thereon for threading to the inner thread 23 of the ferrule 22 and for securing the mold piece 40 to the shaft 15, such that the mold piece 40 may be moved in concert with the shaft 15 and such that the mold piece 40 may also be moved downward toward the plate 11 by the lever 30. The mold piece 40 includes a cavity 43 formed therein for receiving the stud 19 of the shaft 15 and having a non-circular cross section corresponding to that of the stud 19 of the shaft 15 for preventing the mold piece 40 from rotating relative to the shaft 15. Alternatively, the stud 19 of the shaft 15 and the cavity 43 of the mold piece 40 may include a circular cross section and may be keyed together for preventing the mold piece 40 from rotating relative to the shaft 15. The mold piece 40 includes a mold element 44 (FIG. 3) extended downward therefrom and having a shape corresponding to the pattern or the letter or the word to be punched and formed.

A socket 60 is received in the opening 12 of the plate 11 and includes a peripheral flange 61 extended radially outward from the upper portion thereof for engaging with the plate 11 and for supporting the socket 60 in the plate 11. Alternatively, the plate 11 may include a peripheral flange extended radially inward of the opening 12 thereof for engaging with the socket 60 and for supporting the socket 60 in the plate 11. The socket 60 includes one or more notches 62 formed therein for receiving the projections 13 of the plate 11 and for preventing the socket 60 from rotating relative to the plate 11. The opening 12 of the plate 11 and the socket 60, as shown in the drawings, include a circular cross section. Similarly, the opening 12 of the plate 11 and the socket 60 may include a corresponding non-circular cross section for engaging with each other and for preventing the socket 60 from rotating relative to the plate 11. The socket 60 includes a pattern recess 63 formed therein and having a shape corresponding to that of the pattern or the letter or the word to be punched and formed and having a shape corresponding to that of the mold piece 44 for receiving the mold piece 44 (FIG. 5) and for punching and forming the pattern on the sheet members that are engaged between the mold piece 40 and the socket 60 or the plate 11, when the mold piece 44 is moved downward against the socket 60. The cut materials from the sheet members may be received in the pattern recess 63 of the socket 60 and may be removed from the socket 60 when the socket 60 is removed from the plate 11 and is disposed up-side-down, for example. The pattern recess 63 may be formed through the socket 60 for allowing the cut materials to be moved outward of the socket 60.

Figure 4:
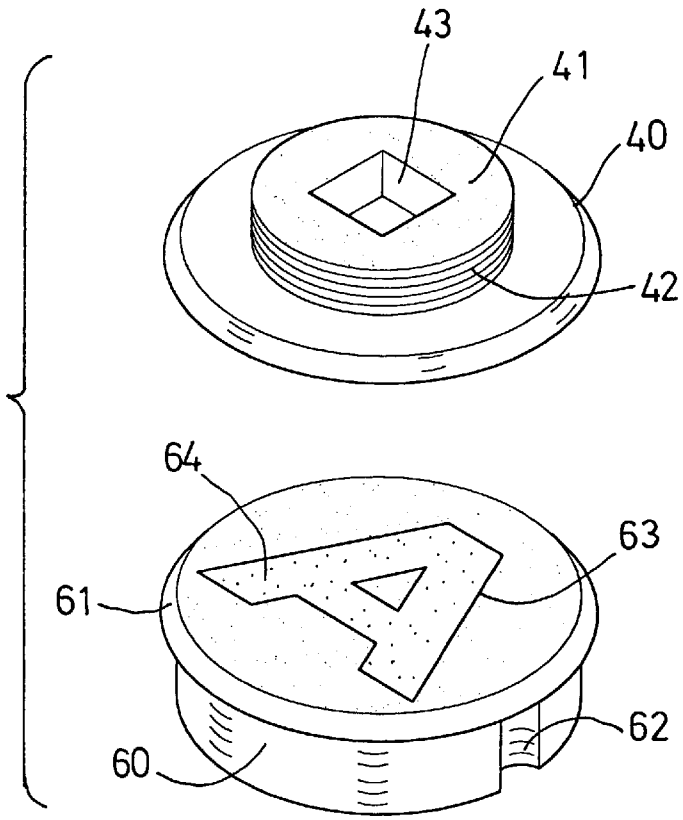
FIG. 4 is a partial exploded view of the punch.

As shown in FIG. 4, a pad 64 has a shape corresponding to that of the pattern or the letter or the word to be punched and formed and has a shape corresponding to that of the mold piece 44 and that of the pattern recess 63 of the socket 60 for engaging into the pattern recess 63 of the socket 60. The pad 64 is made of resilient or soft materials, such as the rubber, and may be deformed or compressed when the mold piece 44 is moved downward against the socket 60 and engaged into the pattern recess 63 of the socket 60. After the punching operation, the resilient pad 64 may be recovered or expanded back to the original shape for moving the cut materials outward of the socket 60 and for allowing the cut materials to be easily removed from the socket 60.

Figure 5:
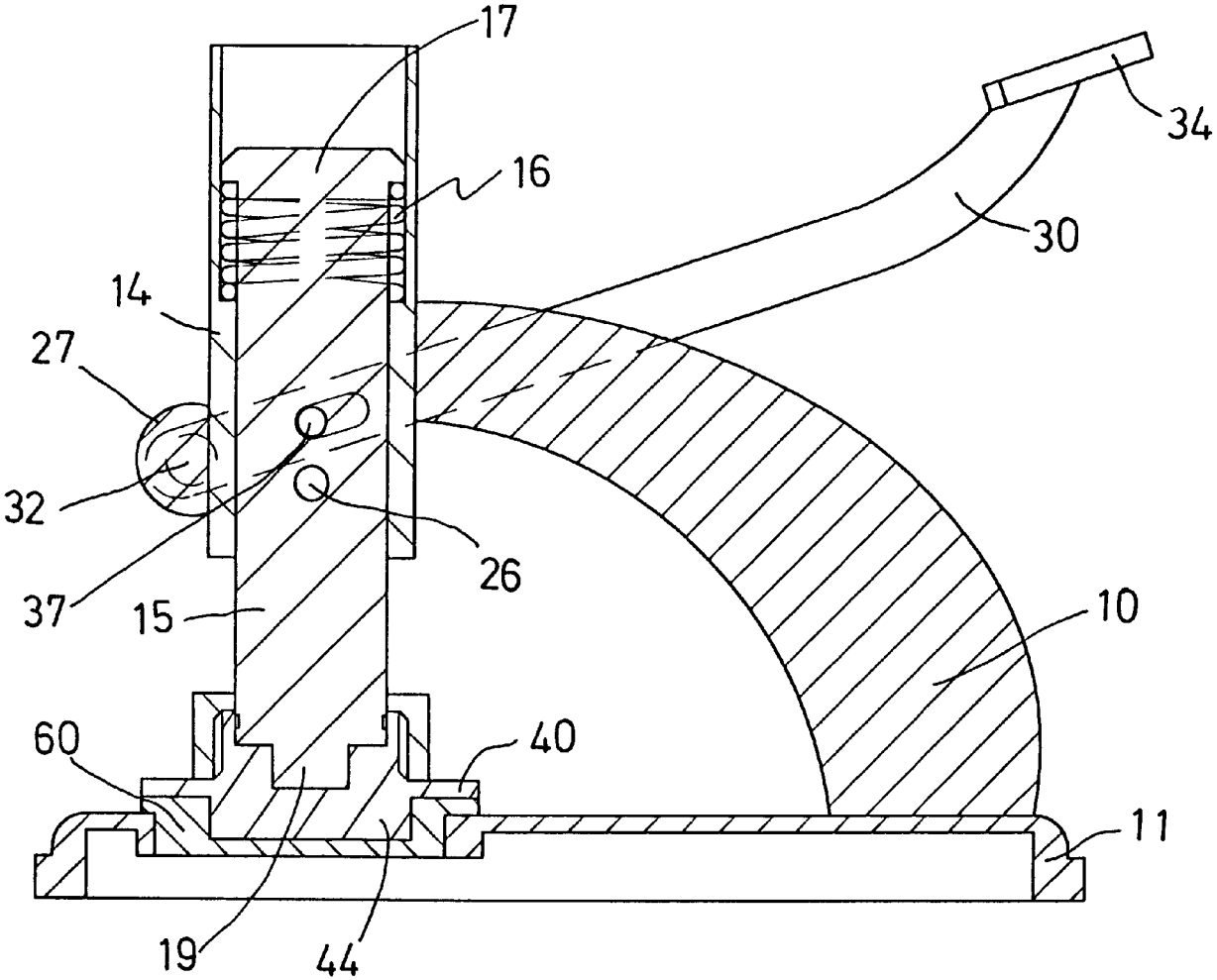
FIG. 5 is a cross sectional view illustrating the operation of the punch.
Figure 6:
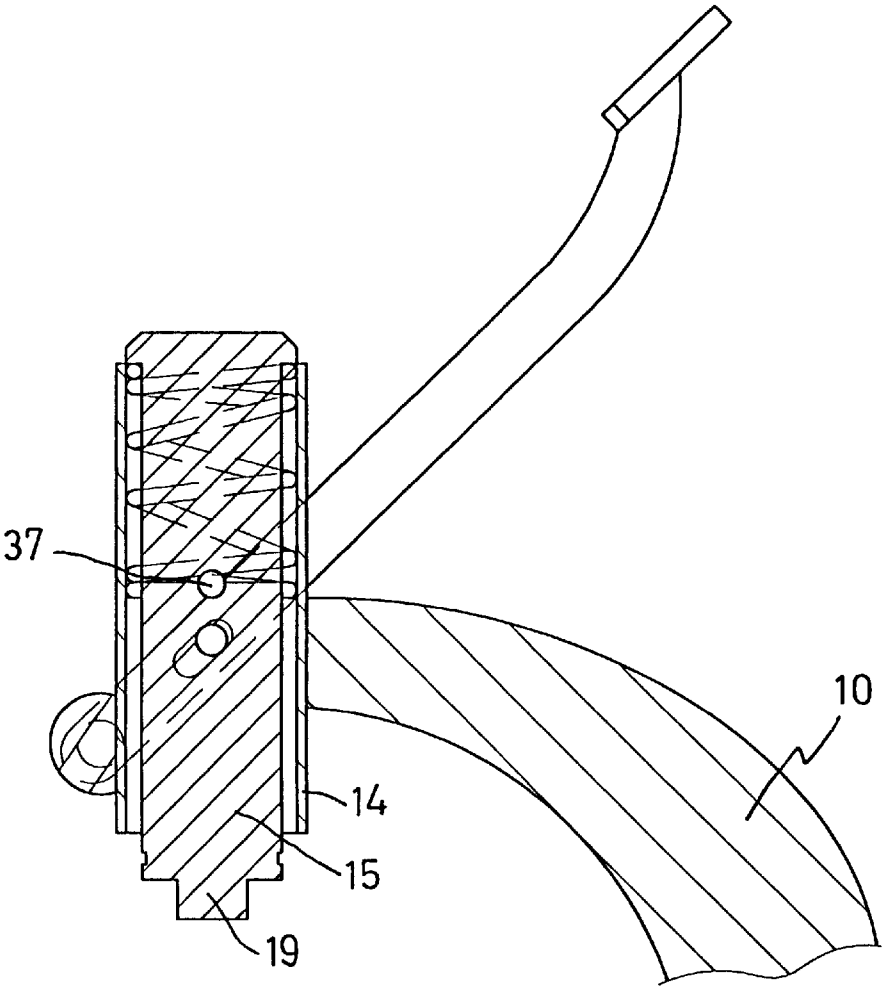
FIG. 6 is a partial cross sectional view illustrating the other application of the punch.

In operation, as shown in FIGS. 3 and 5, the shaft 15 and thus the mold piece 40 may be moved downward toward and to engage with the socket 60 by depressing the handle 34 of the lever 30 against the spring 16. The lever 30 may apply a great force to the mold piece 40 such that the mold piece 40 may be actuate to cut the sheet members of a greater thickness. The punch may include a number of mold pieces 40 having mold elements 44 of various shapes and a number of sockets 60 having the recess 63 of various shapes. The mold pieces 40 and the sockets 60 may be easily changed and replaced with each other.

Accordingly, the punch in accordance with the present invention includes one or more punching members that may be replaced and changed with each other according to the user's need.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A punch comprising:

a plate, a socket supported on said plate and including a recess formed therein, a barrel supported above said plate, a shaft slidably received in said barrel and including a bottom end extended downward and outward of said barrel, a mold piece, means for detachably securing said mold piece to said bottom end of said shaft, said detachably securing means including a ferrule rotatable secured to said shaft, and means for attaching said mold piece to said ferrule, and means for moving said shaft and said mold piece downward to actuate on said socket.

2. The punch according to claim 1, wherein said moving means includes at least one lever having a first end pivotally secured to said barrel at a pivot axle and having a middle portion, and a pin engaged through said middle portion of said at least one lever and engaged through said shaft for coupling said at least one lever to said shaft.

3. The punch according to claim 2, wherein said barrel includes at least one oblong hole formed therein for slidably receiving said pin and for guiding said pin to be moved up and down relative to said barrel.

4. The punch according to claim 3, wherein said shaft includes at least two holes formed therein for selectively receiving said pin.

5. The punch according to claim 1 further comprising means for biasing said shaft and said mold piece away from said socket.

6. The punch according to claim 1, wherein said attaching means includes an inner thread formed in said ferrule, and an outer thread formed on said mold piece and threaded with said inner thread of said ferrule to secure said mold piece to said ferrule.

7. The punch according to claim 6 further comprising means for preventing said piece from rotating relative to said shaft.

8. The punch according to claim 7, wherein said rotating preventing means includes a stud extended from said shaft, and a cavity formed in said mold piece for receiving said stud of said shaft, said cavity of said mold piece and said stud of said shaft include a corresponding non-circular cross section for preventing said mold piece from rotating relative to said shaft.

9. The punch according to claim 1 further comprising means for preventing said socket from rotating relative to said plate.

10. The punch according to claim 9, wherein said plate includes an opening formed therein for receiving said socket, said rotating preventing means includes at least one projection extended inward of said opening of said plate, and at least one notch formed in said socket for receiving said at least one projection and for preventing said socket from rotating relative to said plate.

11. The punch according to claim 1, wherein said socket includes a recess formed therein, said mold piece includes a mold element extended therefrom for engaging into said recess of said socket.

12. The punch according to claim 11 further comprising a pad engaged into said recess of said socket.

* * * * *